United States Patent [19]

Tromble et al.

[11] Patent Number: 4,729,613

[45] Date of Patent: Mar. 8, 1988

[54] HOUSEHOLD REFRIGERATOR PAN ASSEMBLY

[75] Inventors: Ralph D. Tromble; Clarence W. Denham, both of Louisville, Ky.

[73] Assignee: General Electric Company, Louisville, Ky.

[21] Appl. No.: 930,241

[22] Filed: Nov. 13, 1986

[51] Int. Cl.[4] ..... A47B 51/00

[52] U.S. Cl. ..... 312/270; 62/465; 211/153

[58] Field of Search ..... 62/465, 466; 312/270, 312/343, 345; 248/298; 211/153

[56] References Cited

U.S. PATENT DOCUMENTS

| | | | |
|---|---|---|---|
| 2,241,053 | 5/1941 | Brightman et al. | 312/270 X |
| 2,484,997 | 10/1949 | Heiderblest | 312/345 X |
| 2,509,613 | 5/1950 | Philipp | 62/103 |
| 2,665,817 | 1/1954 | Whitmore | 312/345 X |
| 2,745,710 | 5/1956 | Cardby | 312/345 X |
| 2,768,510 | 10/1956 | McCloy | 62/117.3 |
| 3,015,532 | 1/1962 | Wilson | 312/343 |
| 3,063,772 | 11/1962 | Kennedy | 312/308 |
| 3,108,455 | 10/1963 | Hanson | 62/382 |
| 3,220,789 | 11/1965 | Kronenberger | 312/236 |
| 3,565,504 | 2/1971 | Brown | 312/270 |
| 4,013,434 | 3/1977 | Kronenberger et al. | 62/382 |
| 4,173,378 | 11/1979 | Hanson et al. | 312/296 |
| 4,250,719 | 2/1981 | Grimm et al. | 62/382 |
| 4,488,412 | 12/1984 | Weaver et al. | 62/382 |
| 4,557,118 | 12/1985 | Pink et al. | 62/382 |

*Primary Examiner*—William E. Tapolcai

*Attorney, Agent, or Firm*—Frederick P. Weidner; Radford M. Reams

[57] ABSTRACT

A pan assembly for use in a household refrigerator fresh food compartment comprising a removable rigid unitary frame having two side plates secured within the fresh food compartment to support the frame, a front horizontal support member and a rear horizontal support member rigidly attached to and spanning the distance between the side plates. There are two pans of different widths and having an open top with outwardly depending flanges along the side walls at the top of the pans. Three slide members with horizontal channels receive the pan flanges and support the pans thereon. The slide carriers are supported on the rear and front support members of the frame and are slidable along and removable from the support members. A removable cover is supported on the front and rear support members of the frame above the slide carriers.

8 Claims, 8 Drawing Figures

HOUSEHOLD REFRIGERATOR PAN ASSEMBLY

BACKGROUND OF THE INVENTION

This invention relates to household refrigerators including combination refrigerators—that is, a refrigerator including a freezer compartment on top and a fresh food compartment below, both of which are cooled via circulating air from the two compartments over a single evaporator employing a single fan to accomplish the circulation. This invention relates to a household refrigerator pan assembly wherein there is an arrangement for controlling and adjusting the level of humidity within the pans and also allows for easy removal of the pans from inside the fresh food compartment of the refrigerator even though the access door to the fresh food compartment may not be in a fully open position.

Combination refrigerators, including a single evaporator and a single fan for circulating air from the freezer and fresh food compartments over the evaporator are well known. In the operation of such refrigerators, a major portion of the refrigerated air from the evaporator is directed into the freezer compartment while a smaller portion is directed into the fresh food compartment. When cold air from the freezer compartment is used to cool the fresh food compartment, such air, because of its relative dryness, should not directly contact the fresh foods such as fruits and vegetables as they will be become dried out and lose their freshness. The fresh foods are desirably isolated from the desicating effect of the cooler air so that they may be kept cool, yet moist. Sealed compartments or pans have heretofore been used for this purpose. It is desirable, however, that such pans have the humidity inside the pan adjustable or controllable by the user to provide the desired humidity, depending on the type of food load. The food load is the source of moisture inside the pan. Certain types of food have more moisture and will raise the humidity inside the pan as compared to other types of food. Moreover, certain types of food, such as green vegetables, should best be stored at a high relative humidity, while others such as fruit should not. Also, different degrees of humidity are desirable according to the amount of food placed in the pan. Small loads tend to dry out more so than larger loads. Various arrangements in the prior art have been used to adjust pan ventilation and therefore, the humidity inside the pan.

One arrangement for adjusting the pan ventilation and therefore controlling the humidity within the pan is U.S. Pat. No. 4,250,719 assigned to the same assignee as the present invention. In that arrangement the pan assembly includes a storage pan having an open top with a stationary cover secured to the inside of the fresh food compartment of a refrigerator for receiving the pan. There is a separate cover panel within the stationary cover which is movable back and forth along the top of the pan by a manually movable control mechanism and associated linkage. In the high humidity position the separate cover panel covers the open top of the pan and in the low humidity position the pan is open at the front and rear. With this arrangement, the user of the refrigerator may move the control mechanism to increase or decrease the amount of ventilation and, thus, control the humidity inside the pan.

Another arrangement for controlling an adjusting humidity in a pan system is U.S. Pat. No. 4,013,434. In this arrangement the pans have guides along the side of the pan cover that have vents which are covered by a rotatable damper having a plurality of positions and rotation thereof controls the ventilation of the pans.

U.S. Pat. No. 4,557,118 has an arrangement wherein there is a passageway all along the rear of the pan which is unsealed and therefore continuously open to allow air to enter into the pan through that opening. The front of the cover has a passageway with a slide gate for the user to vary the amount of ventilation of the pan.

In household refrigerators it is highly desirable to be able to have a pan system located in the fresh food compartment which includes two pans side by side and preferably one being substantially larger than the other. The reason, of course, is that larger vegetables and fruits may be stored in the larger pan and smaller vegetables may be stored in the smaller pan. It is also desirable to be able to interchange the pans for user convenience. It is common that these two side by side pans span the distance between the side walls of the interior of the fresh food compartment. One of the problems presented with this arrangement is that in many instances the access door of the fresh food compartment may not be permitted to pivot about the hinged side sufficiently to allow the pan next to the hinged side of the door to be removed from the interior of the fresh food compartment without being blocked by the door. It is, therefore, highly desirable to be able to have a pan system that will enable the user to remove the pans from the refrigerator easily when the door may only be partially opened. Furthermore, it is highly desirable to utilize the cover of the side by side pans as a shelf for storing articles in the fresh food compartment. However, the pan system should allow removal of the pans from within the fresh food compartment without unloading and removing the cover/shelf. One such arrangement is shown in U.S. Pat. No. 3,063,772 wherein there is a stationary glass shelf with two pans underneath the shelf. One pan is mounted on a rigid stationary glide. The other pan closest to the hinge side of the door has a rigid slide structure that conforms to the size of the one pan that it carries. To remove this pan from the fresh food compartment the pan mounted on the stationary glide must be removed first and then the slide structure and pan that it carries is moved in a horizontal direction transverse to its direction of removal and the pan then pulled out and removed from the slide structure. Such an arrangement, however, does not allow for the pans to be of different sizes and interchangeable from one side to the other which is very important in household refrigerators that have right and left hand opening doors. Moreover, the glides and slide structure cannot be removed for cleaning nor can the stationary glass cover.

By this invention there is provided a household refrigerator pan assembly which controls and adjusts the level of humidity within the pans, has a cover for the pans that also is a shelf which does not need to be unloaded and removed before removing the pans from inside the fresh food compartment, that allows two pans of different widths to be utilized in the pan system and be interchangeable, and allows for the entire pan system to be removed piece by piece from within the fresh food compartment for cleaning if desired by the user.

SUMMARY OF THE INVENTION

There is provided a pan assembly for a refrigerator which includes a removable rigid unitary frame having two side plates secured within the fresh food compartment to support the frame, a front horizontal support member and a rear horizontal support member rigidly attached to and spanning the distance between the side plates. Two pans of different widths, each having an open top and outwardly depending flanges along the side wall at the top thereof, are mounted slidably on three slide carriers with horizontal channels that receive the pan flanges and support the pans thereon. The slide carriers are supported on the rear and front support members of the frame and are slidable along and removable from the support members. A removable cover is supported on the front and rear support members of the frame above the slide carriers.

DESCRIPTION OF THE PREFERRED EMBODIMENT

Figure 1:
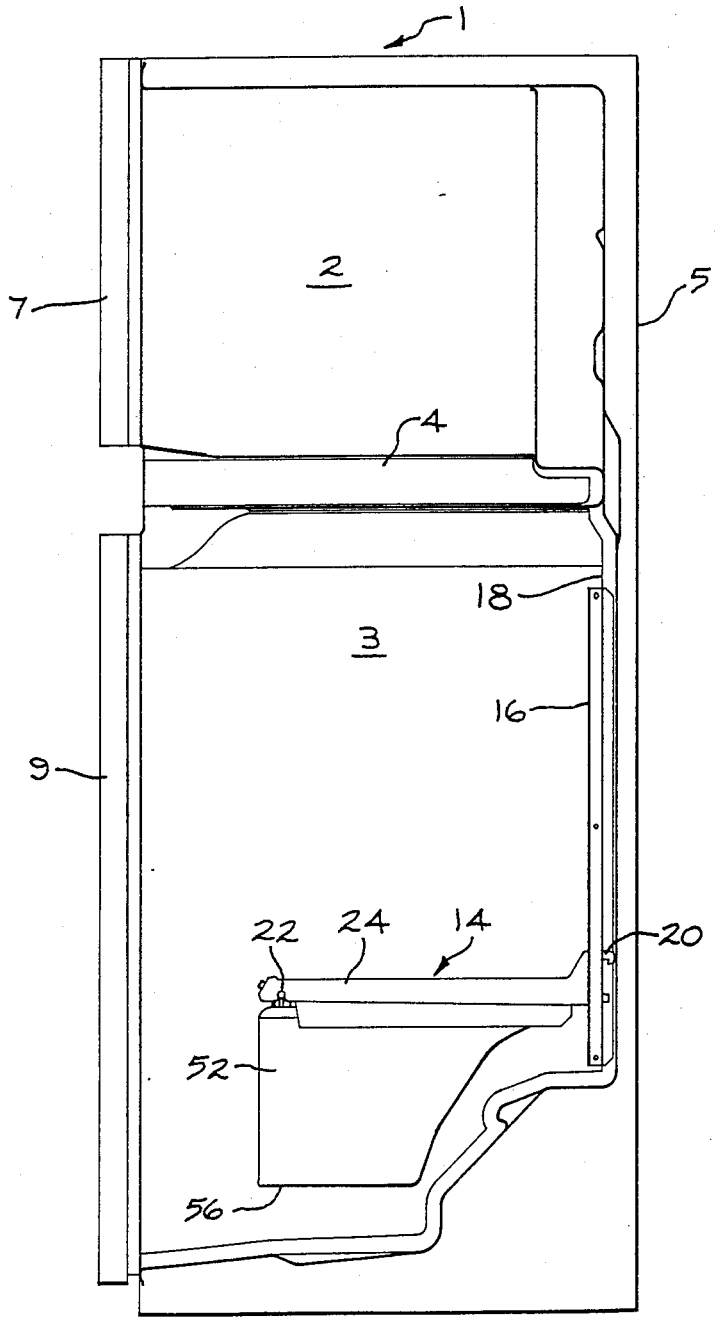
FIG. 1 is a side elevational view of a refrigerator cabinet having a freezer compartment on top and a fresh food compartment on the bottom and embodying one form of the present pan system invention.

With particular reference to FIG. 1 of the drawings, there is shown one embodiment of the present invention in the form of a household refrigerator 1, including an upper freezer compartment 2 and a lower fresh food compartment 3 separated from the freezer compartment by an insulated partition 4. The respective compartments are also separated from the outer cabinet walls 5 and the spaces between the compartments and these walls are filled with thermal insulation (not shown). A hinged door 7 permits access to the freezer compartment 2 and a hinged door 9 permits access to the fresh food compartment 3.

As is common to refrigerators of this design, the compartments are maintained at the desired refrigerating temperatures by means of a single evaporator which operates at a below freezing temperature. Air cooled by the evaporator is directed into the two compartments by a forced air circulating system. Most of the air passes into the freezer compartment while a portion of the cooled air is directed by air duct means located at the rear of the compartments downwardly into the fresh food compartment.

Figure 2:
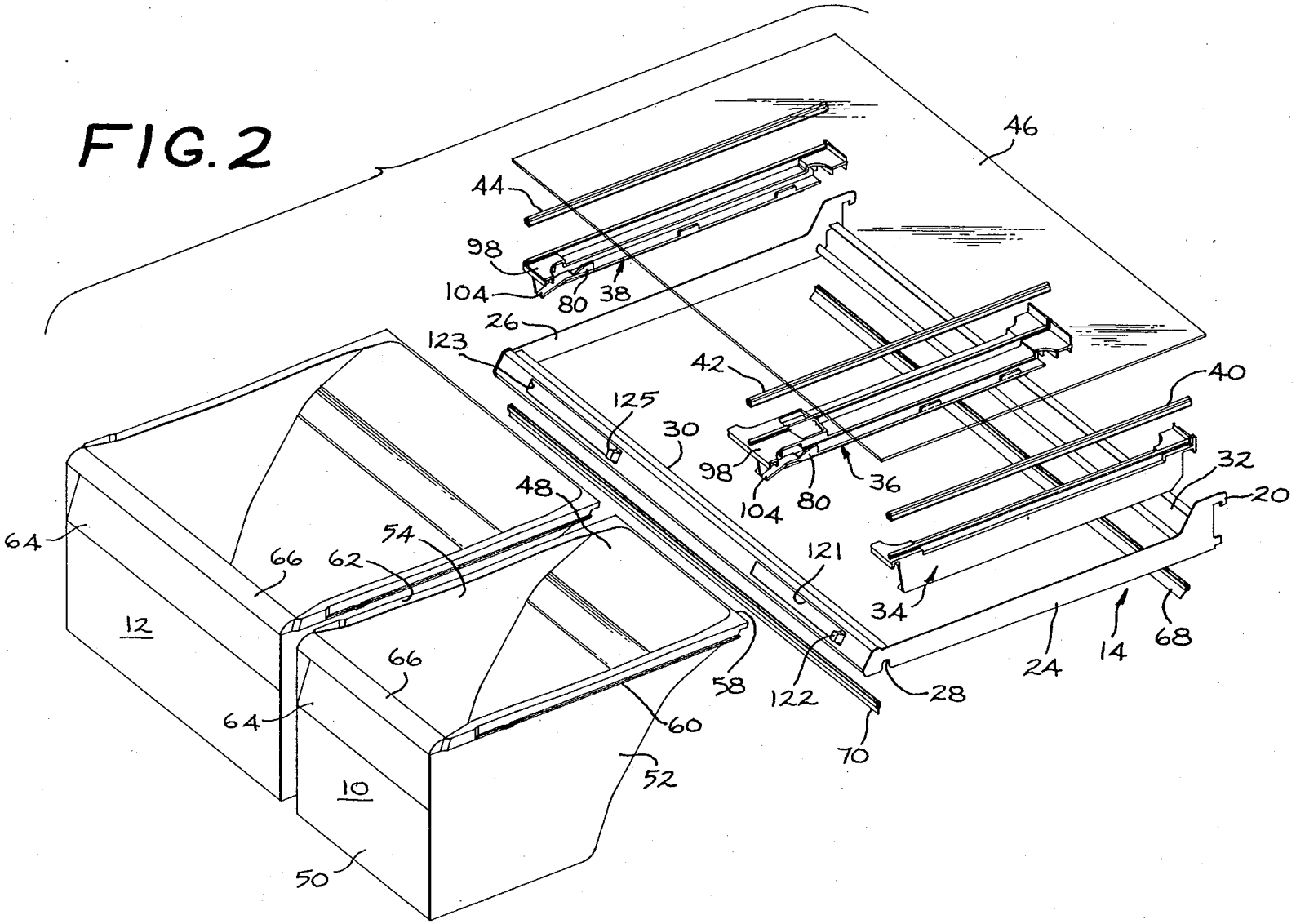
FIG. 2 is an exploded perspective view of the pan system of the present invention.

In household refrigerators, it is desirable to provide a pan and in the case of the present invention two side by side pans in the fresh food compartment 3 in which fresh fruits and vegetables may be kept. As shown in FIG. 2, one pan 10 has a width smaller than the larger pan 12 and they are positioned side by side. In the preferred embodiment of the present invention both pans 10 and 12 are supported by a rigid frame 14 in such a manner that the pans may slide in and out relative to the rigid frame. The rigid frame is attached at the rear thereof to spaced vertical slotted tracks 16 which are suitably secured to the back wall of liner 18 of the fresh food compartment 3 (FIG. 1). The rigid frame 14 is provided at the rear with hook shaped projections 20 which engage the slots in the tracks and retain the frame and the pans at the rear. The rigid frame 14 is supported at the front by means of support members 22 that are secured to the side walls of the fresh food compartment and the front portion of the rigid frame rests on the support members.

Figure 3:
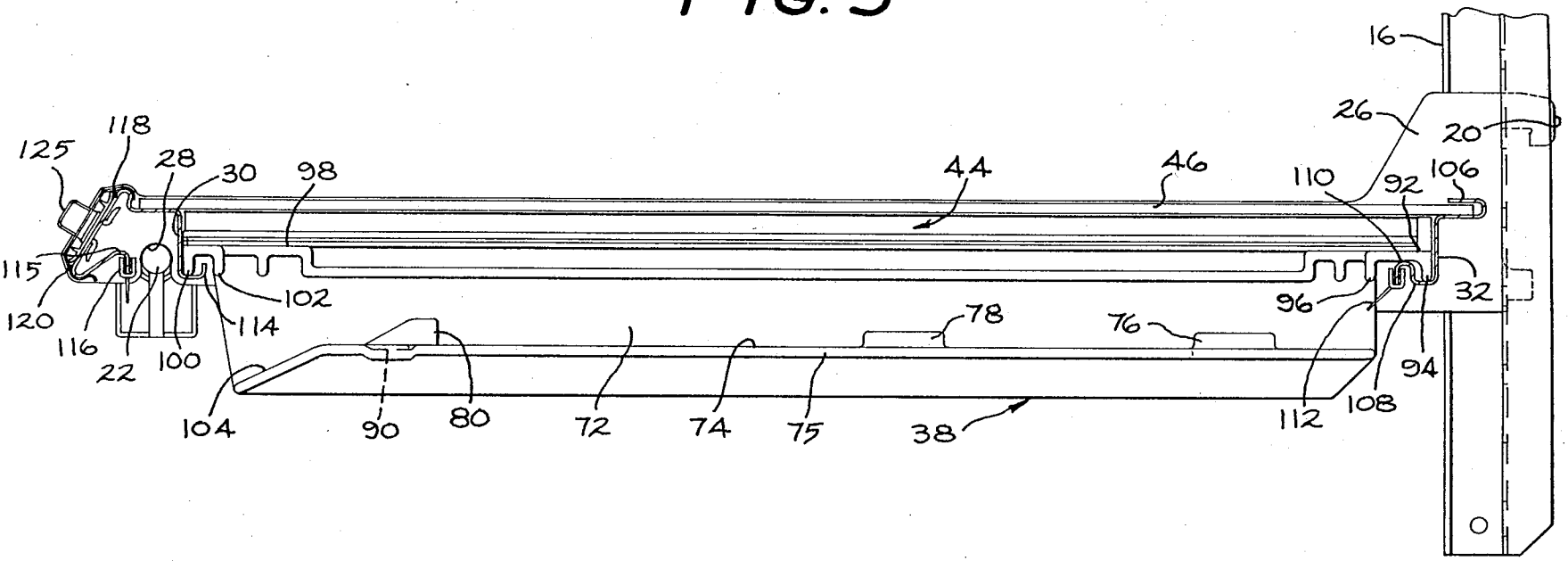
FIG. 3 is a side elevational view of a portion of the pan system of the present invention assembled.
Figure 4:
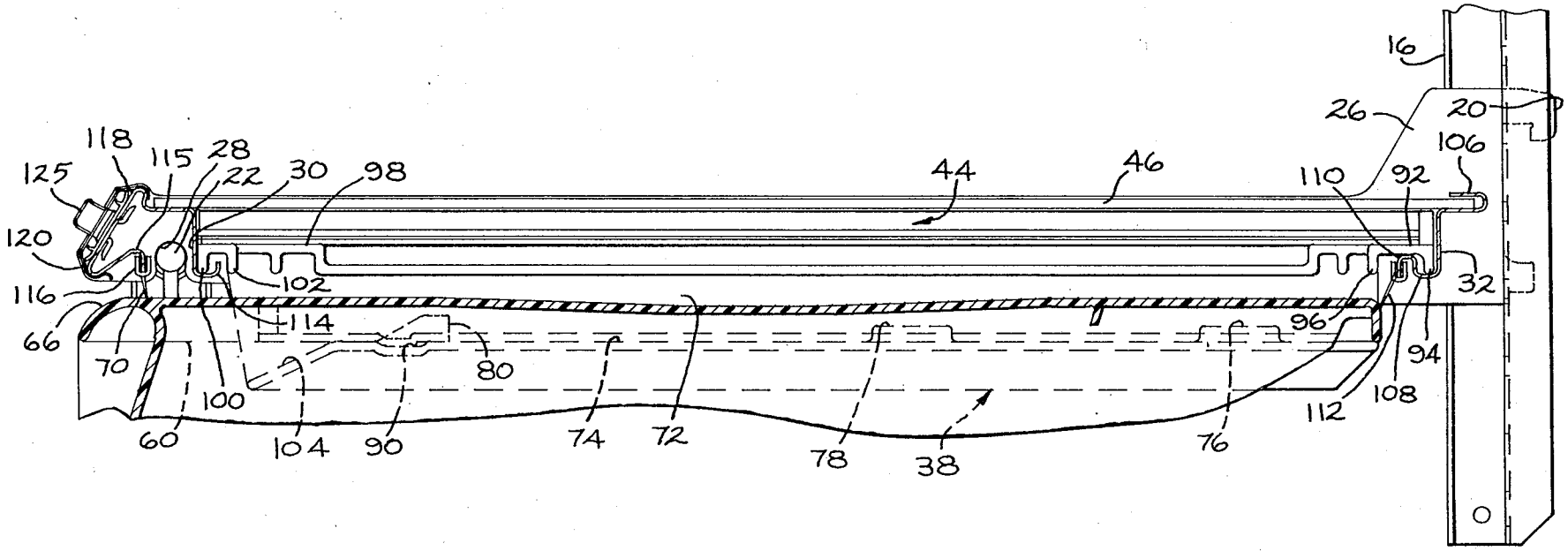
FIG. 4 is a view similar to FIG. 3 showing the pan system of the present invention fully assembled.
Figure 5:
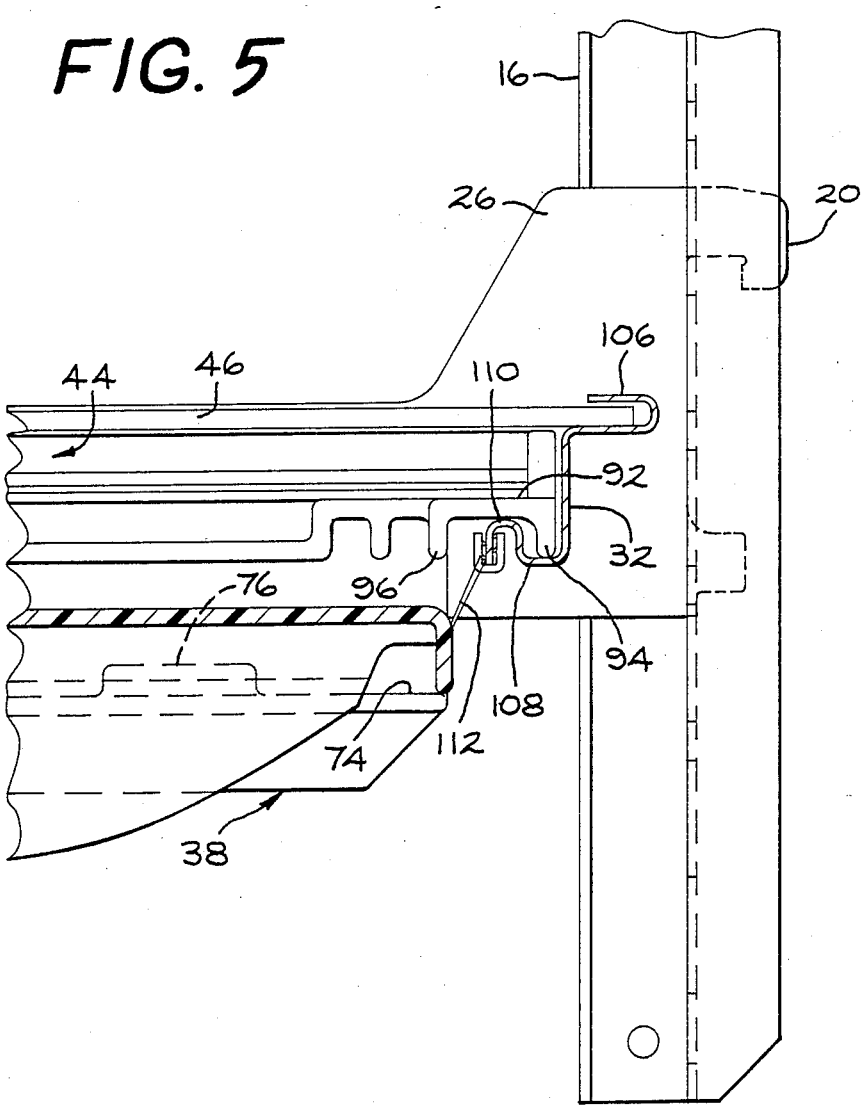
FIG. 5 is an enlarged view of the rear portion of the pan assembly shown in FIG. 4.
Figure 6:
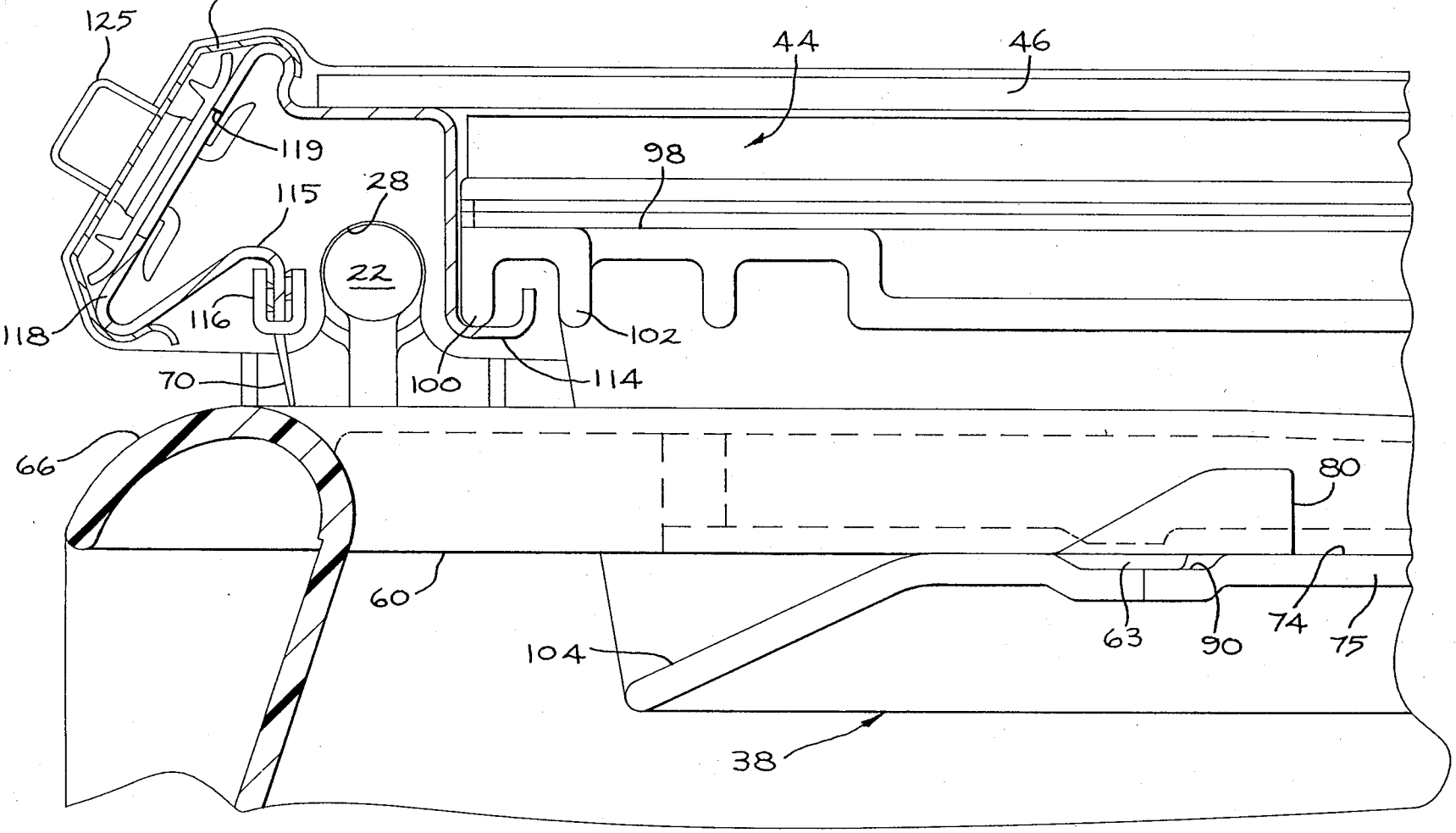
FIG. 6 is an enlarged view of the front portion of the pan assembly shown in FIG. 4.
Figure 7:
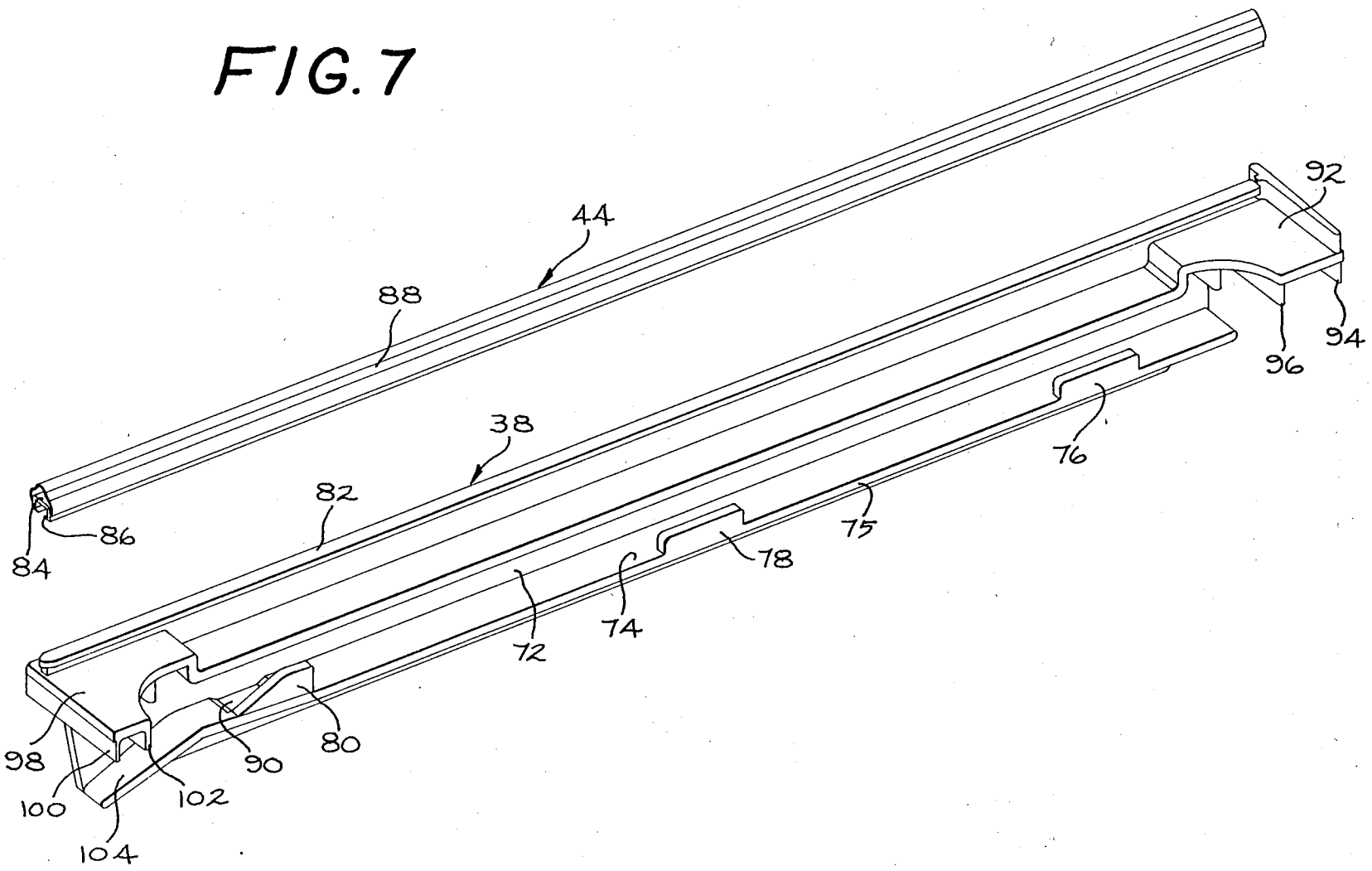
FIG. 7 is an exploded perspective view of one of the side slide carriers of the present invention.

With reference particularly to FIGS. 2–4, the pan assembly of the present invention comprises the rigid frame 14 which is unitary and has two side plates 24 and 26 which have at the rear thereof hook shaped member 20, which, as mentioned previously, is attached to the vertical slotted tracks at the rear of the fresh food compartment of the refrigerator. The front of the side plates have a recess 28 which rests on the support members 22 projecting outwardly from each of the side walls of the fresh food compartment near the front access opening. The frame also has a front horizontal support member 30 and a rear horizontal support member 32, both of which are rigidly attached to and span the distance between the side plates 24 and 26.

There are three slide carriers 34, 36 and 38 which are supported on the rear and front support members of the rigid frame and are slidable along and removable from the support members. The slide carriers 34 and 38 are usually located adjacent the side plates 24 and 26 respectively. Slide carrier 36 is located intermediate the slide carriers 34 and 38. Each of the slide carriers has secured to them at the top thereof elongated seals 40, 42 and 44 for slide carriers 34, 36 and 38, respectively.

The cover for the pan assembly is a removable cover 46 which in the preferred embodiment is made from tempered glass and is supported by the rigid frame 14 and rests on the flexible seals 40, 42 and 44. This removable cover also acts as a shelf in the fresh food compartment so that items to be refrigerated may be placed on top of the cover.

Both the small pan 10 and the large pan 12 have a back wall 48, a front wall 50, side walls 52 and 54, bottom wall 56 (FIG. 1) and an open top having a periphery 58. Along the periphery of the open top at the junction of the side walls 52 and 54 there are outwardly and downwardly depending flanges 60 and 62 that generally extend along the length of the top portion of the side walls 52 and 54. On the front wall 50 of each of the pans 10 and 12 there is a recess 64 with an outwardly depending flange 66 to allow the user to grip the pan for moving it in and out relative to the rigid frame 14.

The rigid frame 14 has secured to it at the rear thereof a gasket 68 which is attached to and runs along the length of the rear horizontal support member 32. At the front of the rigid frame 14 is a gasket 70 which is secured to and runs along the front horizontal member 30. The purpose of these seals 68 and 70 is that when the pans 10 and 12 are in their fully rearward position in the rigid frame 14 the seal 68 seals along the upper edge of the rear wall 84 of both pans 10 and 12 and gasket 70 seals against the upper edge of the front wall 50 of both pans 10 and 12.

With reference particularly to FIGS. 3–8, the details of the structural components of the pan assembly of the present invention will now be described. Slide carriers 34 and 38 are the same in structure but slide carrier 34 is for the right hand side of the pan assembly and slide carrier 38 is for the left hand side of the pan assembly.

Accordingly, a description of one slide carrier will describe both. As can be seen most clearly in FIG. 7, the slide carrier 38, which may be molded from suitable plastic has a vertical side wall 72 which is in close proximity or abuts the side plate 26 when the pan assembly is in its assembled condition. Depending outwardly from the vertical side wall 72 is a horizontal rail 74 which extends nearly the entire length of the elongated slide carrier. At the terminal edge 75 of the rail 74 there are upwardly depending projections 76, 78 and 80. Projection 76 is located near the rear of slide carrier 38, projection 78 is located in the middle of the rail 74, and projection 80 is located at the front of the rail 74. Projections 76, 78 and 80 cooperate with the horizontal rail 74 and the vertical side wall 72 to provide a channel along the length of the slide carrier and this channel is dimensioned to receive the flanges 62 of the pan 12 (FIG. 2). At the top of the vertical side wall 72 is a T-shaped rail 82 that will slidably receive the seal 44 which has a channel member 84 with in-turned projections 86 which will engage the T-shaped rail 82 and be retained thereon. Attached to the channel member 84 is a resilient seal member 88 and this seal 44 extends nearly the entire length of the slide carrier 38. Molded in the rail 74 is a recess area 90 located between the projection 80 and the vertical side wall 72, the purpose of which will be explained later. At the rear of the slide carrier is a downwardly directed channel formed by a horizontal section 92 and two spaced apart downwardly depending legs 94 and 96. The front of the slide carrier 38 has a channel formed by a horizontal section 98 and two downwardly depending spaced apart legs 100 and 102, the purpose of which will be explained later. For ease of positioning the pans 10 and 12 so that their flanges may be received in the elongated channel of the slide carrier there is an inclined portion 104.

Figure 8:
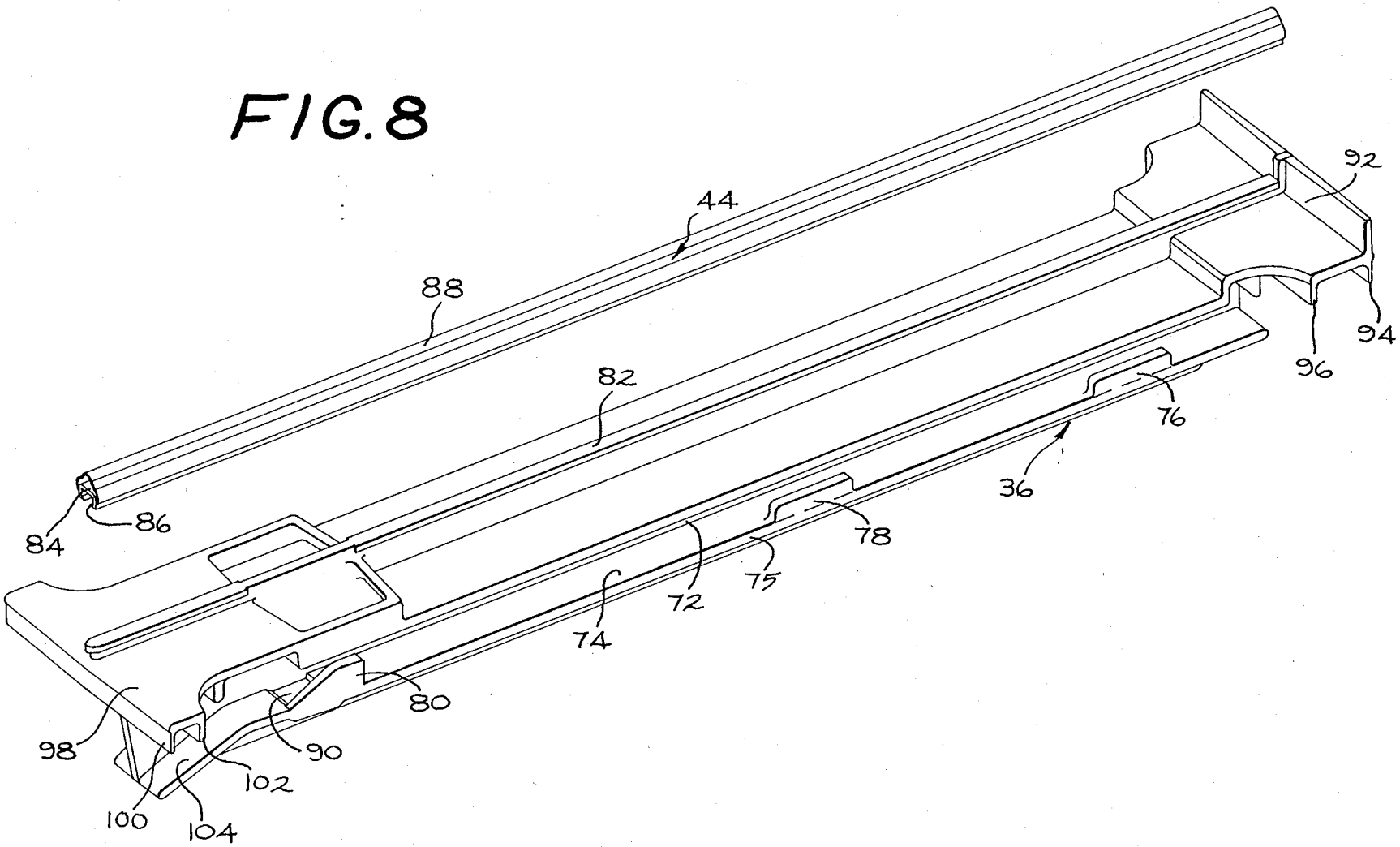
FIG. 8 is an exploded perspective view of the center slide carrier of the present invention.

With reference to FIG. 8, the slide carrier 36 which is the slide carrier that is intermediate the two end slide carriers 34 and 38 is shown. It will be noted that the structural arrangement is the same as that described in connection with the slide carrier 38 shown in FIG. 7; however, the difference is that it has the same arrangement of members on each side and accordingly these members are numbered the same as those for carrier 38. It will be noted that in the case of slide carrier 36 the seal 44 is located in the middle of the slide carrier between the two sides having the same component elements as described in connection with slide carrier 38.

With reference to FIG. 3, the assembly shown in exploded view in FIG. 2 is shown in its assembled condition but without the pans 10 and 12 in their position on the slide carrier. As shown, the side plate 26 having hook-shaped member 20 is positioned on a vertical slotted track 16 for supporting the rear of the rigid frame and pan assembly and the front is supported by a recess 28 engaging support member 22 which is securely fastened to the side wall of the fresh food compartment of the refrigerator. There are support members 22 for both side plates 24 and 26. The rear horizontal support member 32 which is secured at each end thereof to the side plates 24 and 26 as by welding has formed along its length at the top thereof a U-shaped portion 106 having an open end that receives the rear edge of the removable cover 46. The lower portion of the rear horizontal support member 32 has a channel section 108 along its length which receives the downwardly depending leg 94 of the slide carrier. At the terminal end 110 of the support member 32 there is fastened along the entire length of the support member 32 a gasket seal 112.

The front horizontal support member 30 is also fastened as by welding at both ends to the side plates 24 and 26. The front support member 30 has at one terminal end thereof a channel section 114 formed along its length to receive leg 100 of the slide carrier. The opposite end 115 of the front horizontal support member 30 has attached to it a gasket seal 116. Intermediate the two ends of the front horizontal support member 30 is a relatively flat inclined portion 118 with an elongated slot 119 (FIG. 6) that has an elongated decorative trim strip 120 secured to it. The trim strip 120 has two slots 121 and 123 (FIG. 2) with adjustable slide controls 122 and 125 respectively for opening and closing the slots and they are symmetrically located as shown in FIG. 2.

With reference to FIG. 4, the entire pan assembly is shown in its cooperative relationship with the components of the assembly. The assembly includes the rigid frame 14, the slide carrier 38, the removable cover 46, all of which were described above in connection with FIG. 3. FIG. 4 shows the position of one of the vegetable pans either 10 or 12 in its fully closed position wherein the flange 60 of the pan rests on the horizontal rail 74 of the slide carrier 38 and is located between the vertical side wall 72 and the upwardly depending projection 76. When the pan is in its fully rearward position it will be noted as shown in FIG. 4 that the downwardly depending flange 60 of the pan abuts the gasket seal 112 and the pan is sealed completely across the back. At the front of the pan gasket 70 seals against depending flange 66 and the pan is sealed across the entire width of the pan. When both pans 10 and 12 are in their fully closed position, both pans are sealed across the front and back by gaskets 70 and 112. When each pan 10 and 12 is in its fully rearward or closed position as shown in FIG. 4 the detent 63 falls into recess 90 of the slide carrier, thus indicating to the user that the pan is in its fully rearward position and thereby assures sealing of the gasket 112 and 70 against the pan. With these gaskets sealing the rear and front of the pan and the seals 40, 42, and 44 sealing the sides of the pans between the cover 46 and the slide carriers 34, 36 and 38 the interior of the pans are completely sealed so that desicating air from the fresh food compartment cannot enter these pans when the slide controls 122 and 125 are in the closed position and therefore afford high humidity conditions within the pans. If it is desirable by the user to have lower humidity inside one pan or both pans, then the slide controls 122 and 125 may be opened or adjusted to allow ventilation of the pan and thus lower humidity inside the pan or pans.

The pan assembly of the present invention provides for easily removing the pans from inside the fresh food compartment even if the partially open refrigerator door blocks removal of the pan located on the hinge side of the door. Customarily refrigerator doors open 120o from the closed position and with today's refrigerator doors they contain shelves that extend outwardly from the door and may easily block the vegetable pan located on the hinge side of the door from being withdrawn from the pan assembly. By the pan assembly of this invention the pan opposite from the hinge side of the fresh food door may be removed and then the other pan next to the hinge side of the door together with the slide carriers which support the pan may be moved along the rear horizontal support member 32 and front horizontal support member 30 to position it a distance away from the hinge side of the door so that it may then be easily removable from the fresh food compartment. During movement of the pan away from the hinge side of the door the downwardly depending leg 94 of the slide carrier slides along channel section 108 of rear horizontal support member 32 and leg 100 of the slide carrier slides along channel section 114 of the front horizontal support member 30. Upon movement of the pan sideways the flanges 60 and 62 thereof will cause the slide carriers upon which the pan is supported to also move along with the pan.

By the pan assembly of this invention there is also provided an asseably wherein the pans 10 and 12 which vary in width may be interchangeable with each other so that the user can place the pans on either side as so desired in the fresh food compartment. Moreover, this pan assembly also accommodates refrigerators with reversible doors, that is, doors capable of being hinged on one side or the other depending upon the location of the refrigerator and the desires of the user. In addition, with this pan asseably, pans 10 and 12 may be removed from the fresh food compartment without removing cover 46 which is also used as a shelf on which containers and food are placed for refrigeration. If the user desires to clean the pan assembly, the individual components may be removed and taken to a sink including the pans 10 and 12, slide carriers 34, 36 and 38, cover 46 and frame 14.

The foregoing is a description of the preferred embodiment of the invention and it should be understood that variations may be made thereto without departing from the true spirit of the invention as defined in the appended claims.

What is claimed is:

1. In a refrigerator with a fresh food compartment, a pan assembly comprising:

a removable rigid unitary frame having two side plates secured within the fresh food compartment to support the frame, a front horizontal support member and a rear horizontal support member rigidly attached to and spanning the distance between the side plates, two pans of different widths, each having back, front, bottom and side walls with an open top and outwardly depending flanges along the side walls at the top thereof, three slide carriers with horizontal channels to receive the pan flanges and support the pans thereon, said slide carriers being supported on the rear and front support members of the frame and slidable along and removable from the support members, and a removable cover supported on the front and rear support members of the frame above the slide carriers.

2. In the refrigerator of claim 1 wherein the fresh food compartment has slotted vertical tracks on the rear wall of the compartment and the two side plates each have hook elements at one end thereof for engaging the slotted tracks to support the frame at the rear and the side walls of the fresh food compartment have protruding support members to support the frame at the front.

3. In the refrigerator of claim 1 wherein the removable frame structure of the pan assembly is nearly the entire width of the fresh food compartment.

4. In the refrigerator of claim 1 wherein the slide carriers of the pan assembly have upwardly projecting elongated seal members along the length thereof for sealing against the cover and the frame has a gasket along the back support merber and a gasket along the front support member to seal against the rear and front walls of the pans respectively.

5. In the refrigerator of claim 4 wherein a manually adjustable aperture in air flow communication with the interior of the pans is located on the front support member of the frame of the pan assembly.

6. In the refrigerator of claim 1 wherein the removable cover is tempered glass.

7. In the refrigerator of claim 1 wherein the slide carriers and pans of the pan assembly have cooperating recesses and detents formed therein whereby the pan is retained in a seated location on the slide carriers when in the fully closed position.

8. In the refrigerator of claim 1 wherein the slide carriers are molded plastic.

* * * * *